US006371018B1

(12) United States Patent
Nacash et al.

(10) Patent No.: US 6,371,018 B1
(45) Date of Patent: Apr. 16, 2002

(54) METHOD AND APPARATUS FOR ANILOX ROLLER SCORING PREVENTION

(75) Inventors: David Nacash, Kfar Yona; Vladimir Petrov, Hadera; Aharon Korem, Herzliya; Yossef Halfon, New Givon; Refael Bronstein, Kfar Saba, all of (IL)

(73) Assignee: Karat Digital Press L.P., Herzlia (IL)

( * ) Notice: Subject to any disclaimer, the term of this patent is extended or adjusted under 35 U.S.C. 154(b) by 0 days.

(21) Appl. No.: 09/708,005

(22) Filed: Nov. 8, 2000

Related U.S. Application Data

(60) Provisional application No. 60/194,405, filed on Apr. 4, 2000.

(51) Int. Cl.[7] ..... B41M 1/14

(52) U.S. Cl. ..... 101/211; 382/199; 101/483; 101/212; 101/248; 101/401.1; 345/581; 345/589

(58) Field of Search ..... 101/212, 211, 101/216, 219, 248, 483, 484, 401.1; 382/195, 199; 345/581, 582, 589, 345; 358/1.1, 1.4

(56) References Cited

U.S. PATENT DOCUMENTS

| | | | | | |
|---|---|---|---|---|---|
| 5,313,570 | A | * | 5/1994 | Dermer et al. | 345/589 |
| 5,613,046 | A | * | 3/1997 | Dermer | 358/1.1 |
| 5,668,931 | A | * | 9/1997 | Dermer | 358/1.4 |
| 5,724,259 | A | * | 3/1998 | Seymour et al. | 382/199 |
| 5,903,712 | A | * | 5/1999 | Wang et al. | 101/211 |
| 5,912,988 | A | * | 6/1999 | Moore | 382/209 |
| 5,982,921 | A | * | 11/1999 | Alumot et al. | 382/145 |
| 6,008,800 | A | * | 12/1999 | Pryor | 345/173 |

* cited by examiner

*Primary Examiner*—Eugene Eickholt
(74) *Attorney, Agent, or Firm*—Eitan, Pearl, Latzer & Cohen-Zedek

(57) ABSTRACT

The present invention is directed to various apparatuses and methods for prevention of anilox roller scoring and compensation for anilox scoring ink marks, focusing on the anilox roller. According to some embodiments of the present invention, the uneven ink distribution pattern may be treated by an addition of an ink distribution mechanism. According to other embodiments of the present invention, image data modification methods are used for compensation for the scoring marks.

4 Claims, 14 Drawing Sheets

METHOD AND APPARATUS FOR ANILOX ROLLER SCORING PREVENTION

This application claims the benefit of U.S. Provisional application No. 60/194,405, filed Apr. 4, 2000.

FIELD OF THE INVENTION

The present invention relates generally to printing technologies, and more specifically relates to anilox rollers and means to overcome the problem of anilox scoring.

BACKGROUND OF THE INVENTION

Anilox inking printing systems are used in flexography and lately also in offset printing. Reference is now made to FIG. 1, which illustrates an anilox inking system. An anilox inking system 5 comprises an anilox roller 10 that picks up ink 12 from an ink chamber 14, Anilox roller 10 has an engraved surface, which delivers a fixed amount of ink to an adjacent form roller 16. The ink, which covers form roller 16 with a thin uniform layer, is then transferred to a plate cylinder 18. Anilox inking system 5 further comprises at least one doctor blade 20, which remove excessive ink from anilox roller 10.

One of the problems associated with anilox inking systems is scoring. Scoring means the formation of scores on the surface of the anilox roller. The scoring occurs when a small particle gets stuck in the gap between the blade and the anilox roller and scores the surface during operation. Therefore, the scores are usually perpendicular to the rotation axis of the roller. The particle may be chipped of a wall of an engraved cell or may reach the blade in another way. As a result, the scoring may occur more frequently in offset printing since an offset anilox roller has thinner, more breakable, walls than a flexography anilox roller. The number of engraved cells per unit length on offset anilox rollers may be 280 to 600 cells per inch.

The inking delivery system transfers ink layers having even distribution between successive rollers and to the plate cylinder. The scores on the anilox roller may, however, cause an uneven ink distribution on the rollers and plate cylinder resulting in undesired artifacts on a printed image. These artifacts may reduce the overall print quality to an unacceptable level. Thus, there is a need for a method for the reduction or elimination of the anilox roller scoring marks.

BRIEF DESCRIPTION OF THE DRAWINGS

The subject matter regarded as the invention is particularly pointed out and distinctly claimed in the concluding portion, of the specification. The invention, however, both as to organization and method of operation, together with objects, features, and advantages thereof, may best be understood by reference to the following detailed description when read with the accompanying drawings in which:

Figure 1:
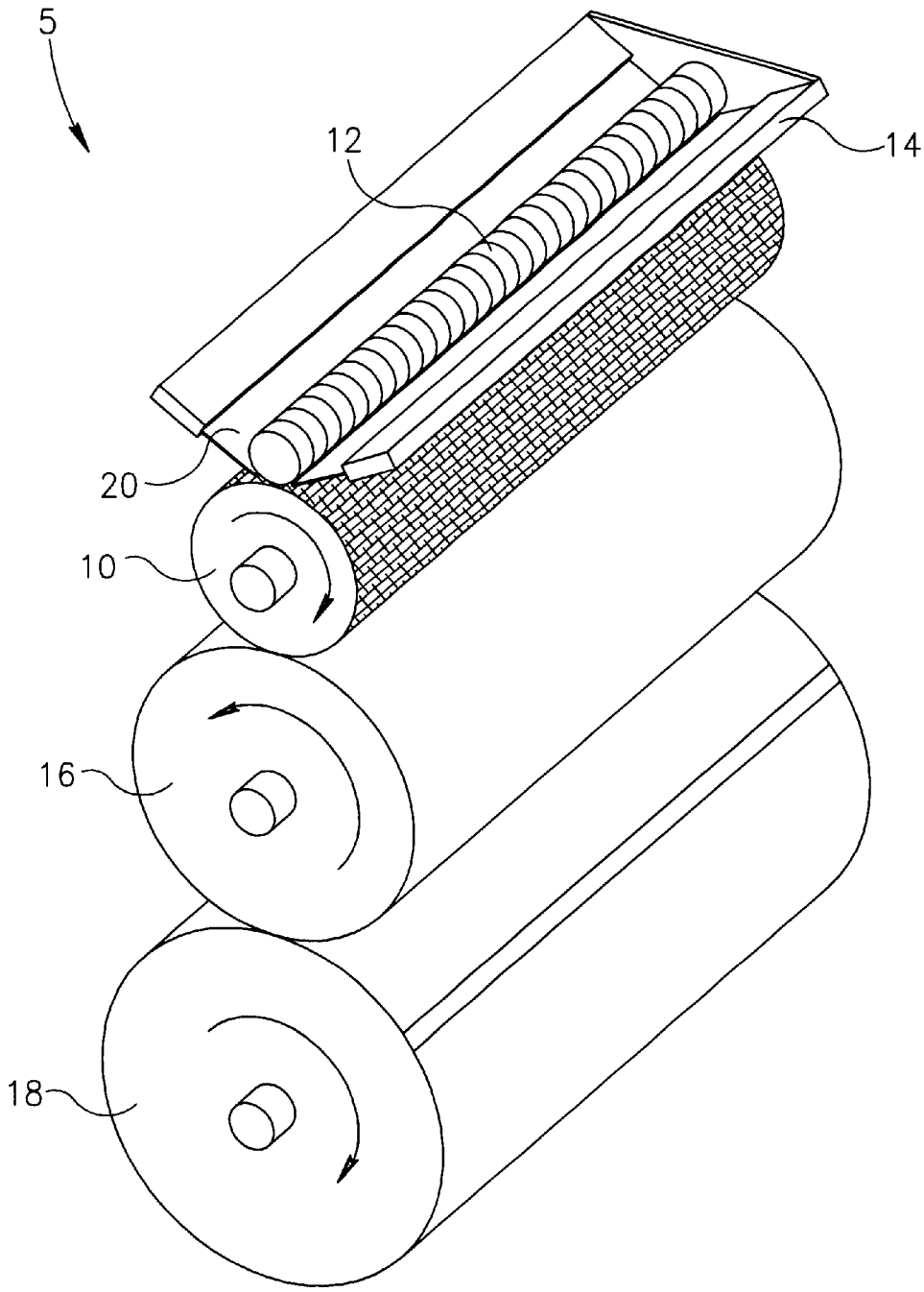
FIG.1 PRIOR ART
FIG. 1 is a schematic illustration of a conventional anilox inking system.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as not to obscure the present invention.

Figure 2A:
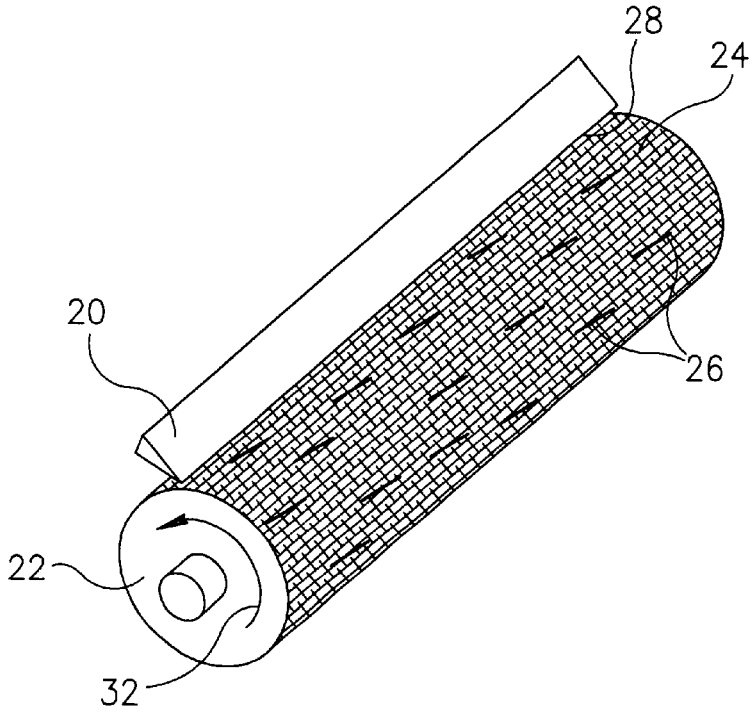
FIGS. 2A and 2B are schematic representations of an anilox roller constructed in accordance with an embodiment of the present invention.
Figure 2B:
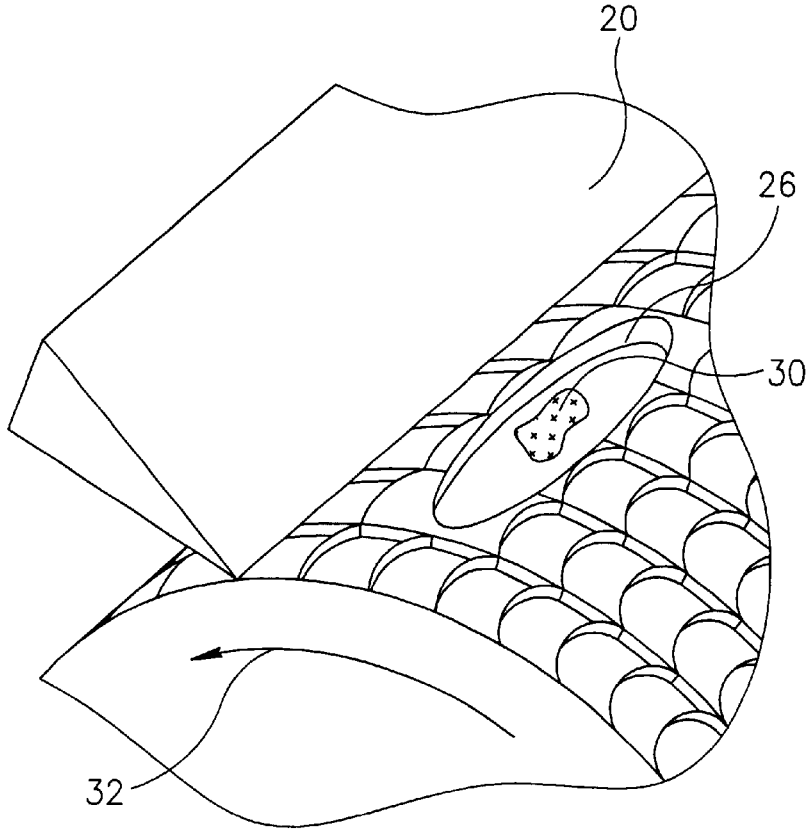
Figure 3A:
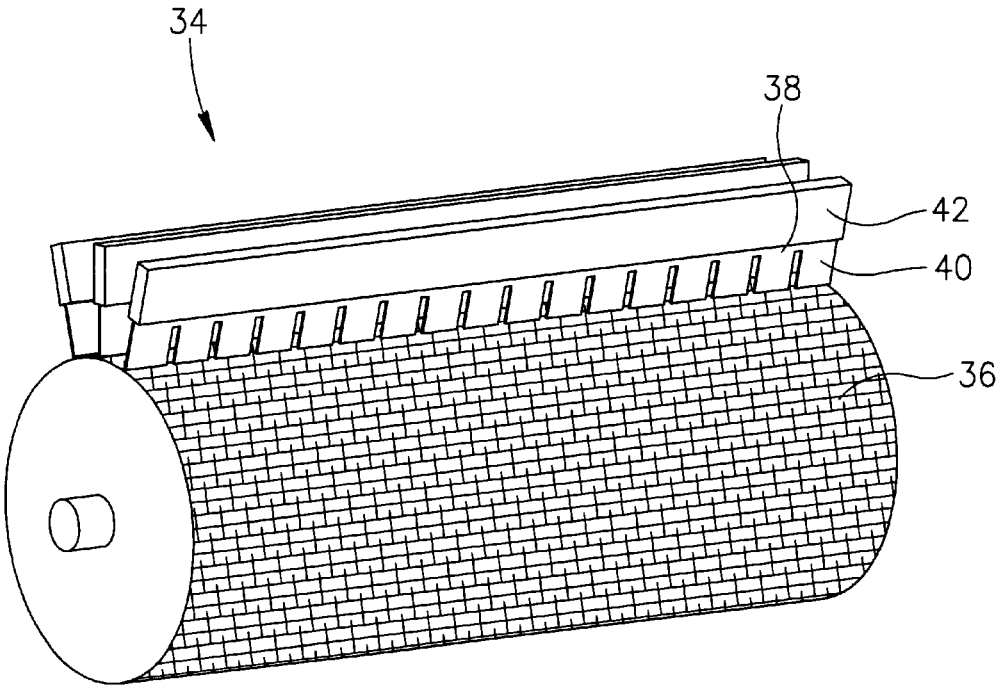
FIGS. 3A and 3B show an array of doctor blades constructed in accordance with an embodiment of the present invention.
Figure 3B:
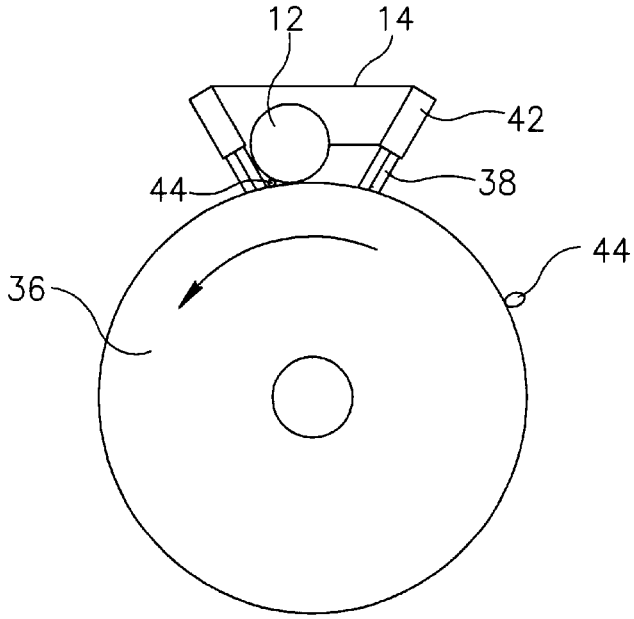

Embodiments of the present invention are directed to various apparatuses and methods for prevention of anilox roller scoring and compensation for anilox scoring ink marks. FIGS. 2A and 2B represent embodiments of the present invention focusing on the anilox roller. FIGS. 3A and 3B represent embodiments of the present invention focusing on the doctor blades, FIGS. 4–7 represent embodiments of the present invention focusing on smearing mechanisms. FIGS. 8–11 of the present invention illustrates image data modification methods for compensation for the scoring marks.

Anilox Roller

Reference is now made to FIG. 2A, where an anilox roller 22 in accordance with the present invention is described. Reference is made additionally to FIG. 2B, which is an enlargement of the anilox roller surface and illustrates the trapping action of a particle by anilox roller 22 of FIG. 2A. The anilox roller is designed to trap small particles and to prevent them from scoring the surface.

Anilox roller 22 comprises an engraved pattern 24 and a plurality of grooves 26 added to it. Doctor blade 20 is coupled to the anilox roller and may be parallel to the longitudinal axis of the anilox roller. The grooves may be inclined at an angle of approximately 5 to 10 degrees to line 28, which illustrates the contact fine between the blade and the anilox roller surface. A small particle 30, such as a ceramic particle chipper off the anilox roller, may reach the vicinity of blade 20. Blade 20 transfers particle 30 into a groove, thus preventing it from being stuck in the gap between blade 20 and anilox roller 22.

The grooves may be arranged in such a way as to provide coverage of the whole anilox roller surface, meaning that a small particle moving on the surface in the direction of an arrow 32 may encounter at least one groove. Arrow 32 indicates the rotation direction of the anilox roller. Particle 30 may be trapped in groove 26 and may not cause any harmful effects to the engraved pattern. The particle or any other trapped small particle is washed out at a regular maintenance procedure.

While this embodiment of the present invention has been described with respect to a particular engraved structure, many modifications may be made by a person skilled in the art.

For example, a second coarser mesh pattern may be engraved on the anilox roller in addition to a first finer mesh pattern. The second mesh pattern may form a small angle with the longitudinal axis of the roller or may be engraved perpendicular to the first mesh direction. To avoid moiré effects between the different mesh patterns, the pitch of the coarser mesh pattern should be an integer multiple of the pitch of the finer mesh pattern. In addition the overall engraved volume of the anilox roller has to match a constant target volume according to the particular printing press properties.

While the anilox roller of FIG. 2 has been described with respect to black and white printing press systems, it is also applicable to a multi-color printing press inking system. However, in this case, the positioning of anilox rollers of different color separations relative each other is of importance. The rollers should be placed in a way that prevents grooves from different rollers to overlap. This non-overlapping pattern may prevent the formation of undesirable artifacts on a printed image.

Doctor Blades

Reference is now made to FIG. 3A, which is an array of flexible doctor blades constructed in accordance with the present invention. A conventional doctor blade may produce excess pressure on the anilox walls and may cause the breakage of the walls. In addition, its structure may not allow the shit of the particle along the surface. The present invention may present a solution to these issues. The doctor blades of the present invention are designed to apply a lesser pressure on the surface and enable a small particle to pass underneath them. Therefore, preventing the particle from being stuck under the blade and scoring the surface.

An array 34 of blades in contact with an anilox roller 36 comprises a plurality of blades 38. Each blade 38 is formed to have a plurality of tooth-like segments 40 and is attached in a flexible manner to a blade holder 42. The blade segments 40 of a particular blade 38 are overlapping the blade segments of other blades 38. The flexible array 34 of blades applies lowered pressure on a small particle and causes less damage to the walls of the cell. Nevertheless, the use of multiple blades ensures an appropriate ink wiping action.

FIG. 3B is a cross section of anilox roller 36 of FIG. 3A in a plane perpendicular to the longitudinal axis of the anilox roller and illustrates the scoring prevention operation, in accordance with the embodiment of FIG. 3A. During the operation of the anilox system, a small particle 44, such as a ceramic chip, ink chunk, a blade sleeve and the like, may reach one of the blades. The flexible blade allows particle 44 to gradually advance with the rotation anilox roller 36 until the particle is either transferred with the ink or returns to a rear blade, where it may be trapped and removed by known means such as magnetic traps.

Redistribution Ink Mechanism

The scoring of the anilox roller may cause an uneven ink distribution on the form roller and the plate cylinder. Treating the uneven ink distribution on the form roller may prevent undesirable artifacts on a printed image. According to some embodiments of the present invention, the ink distribution pattern may be smeared by an addition of an ink redistribution mechanism, as will now be described.

Figure 4:
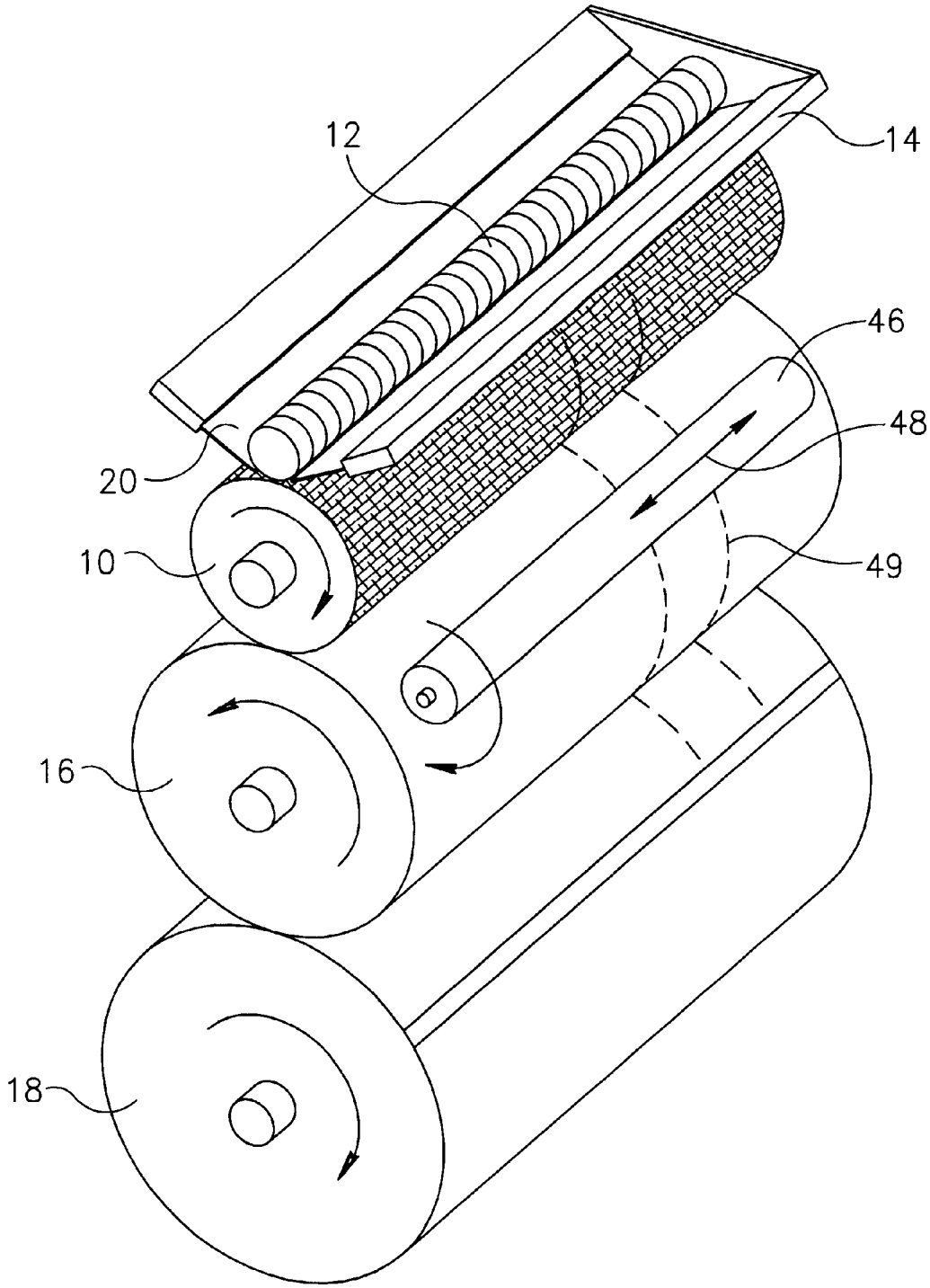
FIGS. 4–6 show schematic representations of an anilox inking system having various mechanisms for smearing of scoring marks, in accordance with some embodiments of the present invention.

Reference is now made to FIG. 4, which is a schematic representation of an inking system having an ink redistribution mechanism, in accordance with an embodiment of the present invention. The printing press inking system of FIG. 4 is similar to that of FIG. 1 and elements in common have the same reference numbers. However, it should be understood that the scope of the present invention is not limited to such a system and the inking system may comprise more than rollers 10 and 16.

The printing press inking system of FIG. 4 further comprises an oscillating roller 46 coupled to form roller 16. Oscillating roller 46 comprises ink-repelling material and is adapted to move in a direction indicated by an arrow 48. The motion of oscillating roller 46 may smear scoring ink marks 49, which may exist on form roller 16. After the smearing operation, form roller 16 picks up fresh ink to be transferred in a much uniform layer to plate cylinder 18. This may result in a printed image without scoring marks effects. It should be noted that oscillating roller 46 operates before form roller 16 picks up fresh ink to be transferred to the plate cylinder in order to prevent ghosting effects on the printed image.

Figure 5A:
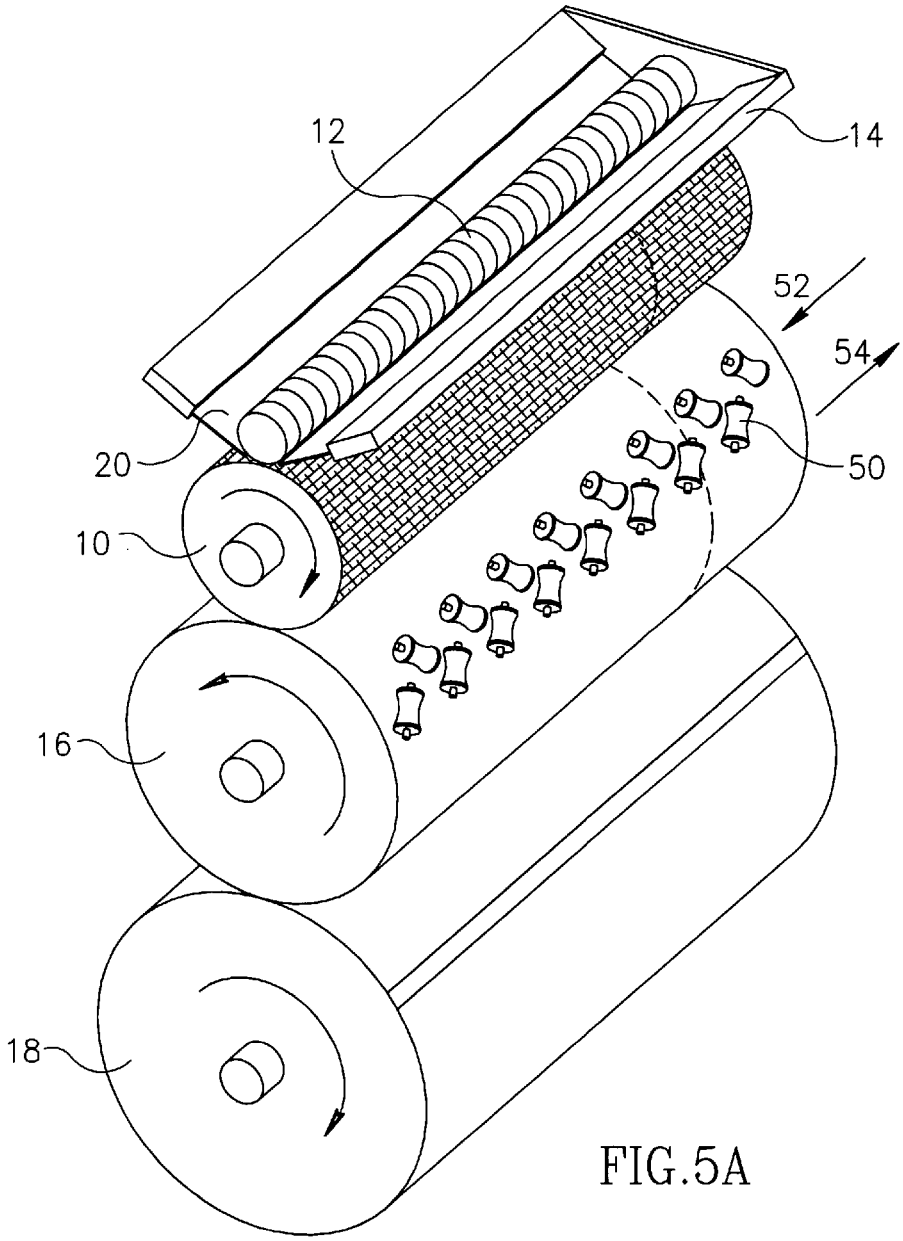
Figure 5B:
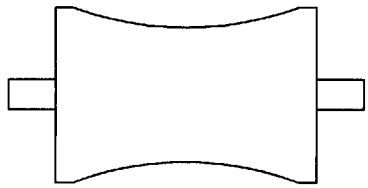

Better and faster ink redistribution may be performed by an arrangement where the contact between the generatrix of the form roller and the oscillating roller is ensured in every point. This requirement is difficult to maintain when the rollers are of relatively large size and are cylindrical in form. FIGS. 5A and 5B show an embodiment of the present invention that may satisfy this requirement.

FIG. 5A shows a schematic representation of an inking system having an ink redistribution mechanism, in accordance with another embodiment of the present invention. The printing press inking system of FIG. 5A is similar to that of FIG. 1 and elements in common have the same reference numbers. The printing press inking system of FIG. 5A comprises a plurality of small ink-repelling rollers 50 in contact with the form roller 16. The small rollers may be oriented in at least two rows of mutually perpendicular directions. When the rollers rotate, they apply oppositely directed forces that cause ink to flow in the directions marked by arrows 52 and 54. This flow of ink effectively reduces the differences in ink layer thickness caused by the scoring. Thus, the plate cylinder picks up a more uniform ink layer for the next printing cycle.

Further improvement of the ink distribution efficiency may be achieved if each of small rollers 50 is configured to have a concave profile, as shown in FIG. 5B. The parameters of the concave profile are calculated from a cross section of the form roller at an angle correlated to the orientation of rollers 50.

Figure 6:
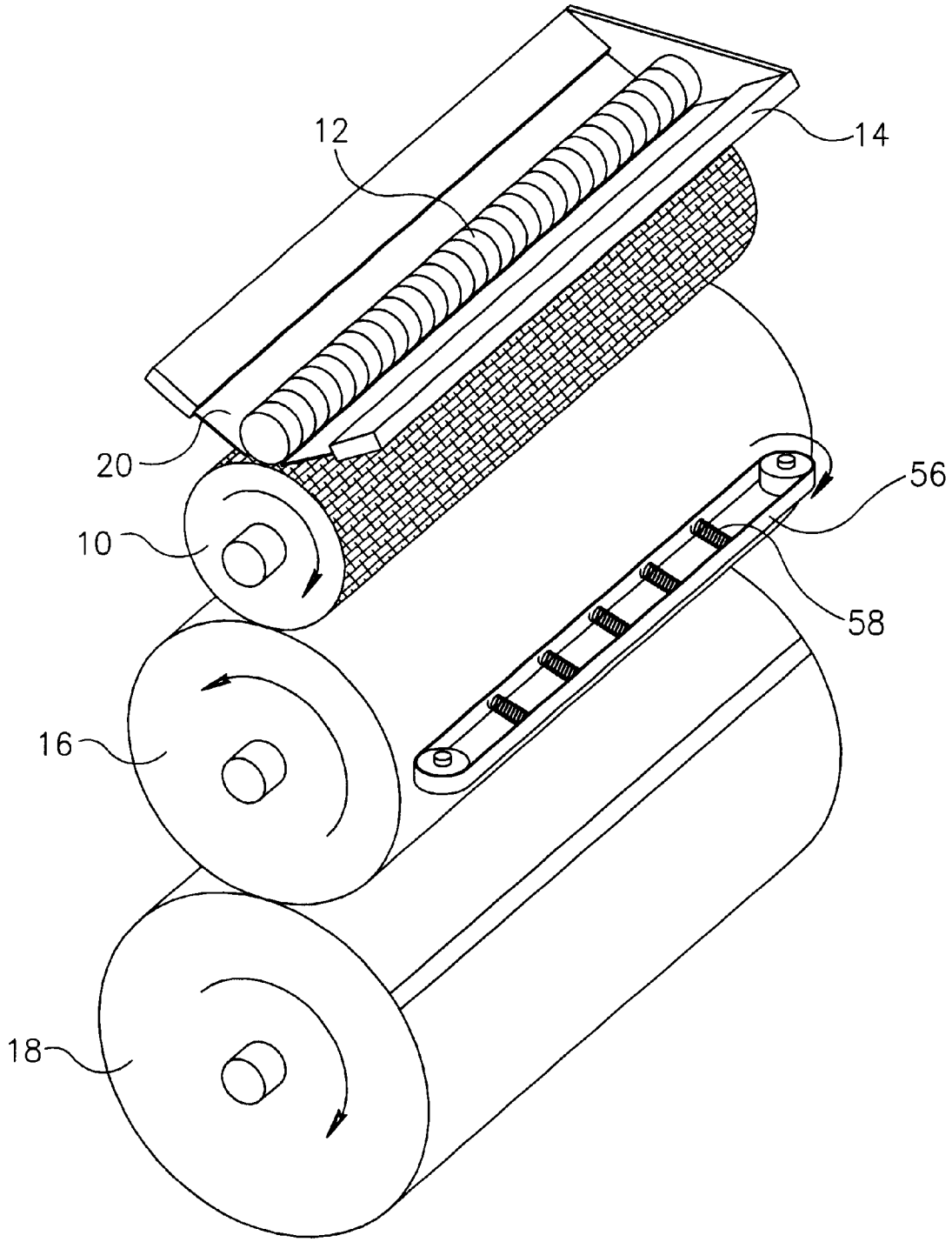

FIG. 6 shows a schematic representation of an inking system having an ink redistribution mechanism, in accordance with yet another embodiment of the present invention. The printing press inking system of FIG. 6 is similar to that of FIG. 1 and elements in common have the same reference numbers.

The printing press inking system of FIG. 6 further comprises a closed belt 56 made of ink repelling material coupled to form roller 16 and a plurality of springs 58 adapted to ensure the contact between belt 56 and form roller 16. The closed belt is adapted to move in the direction of the longitudinal axis of the roller before fresh ink is picked up.

A person of ordinary skill in the art will appreciate that other mechanisms of ink redistribution may be used in embodiments of the present invention, such as, but not limited to, rotating brushes and oscillating flexible knives made of different materials.

The speed of ink redistribution depends on the viscosity of the ink, which is a function of the ink temperature. Radiation or applying hot air-stream may increase the ink temperature and accordingly reduce the ink viscosity.

Figure 7:
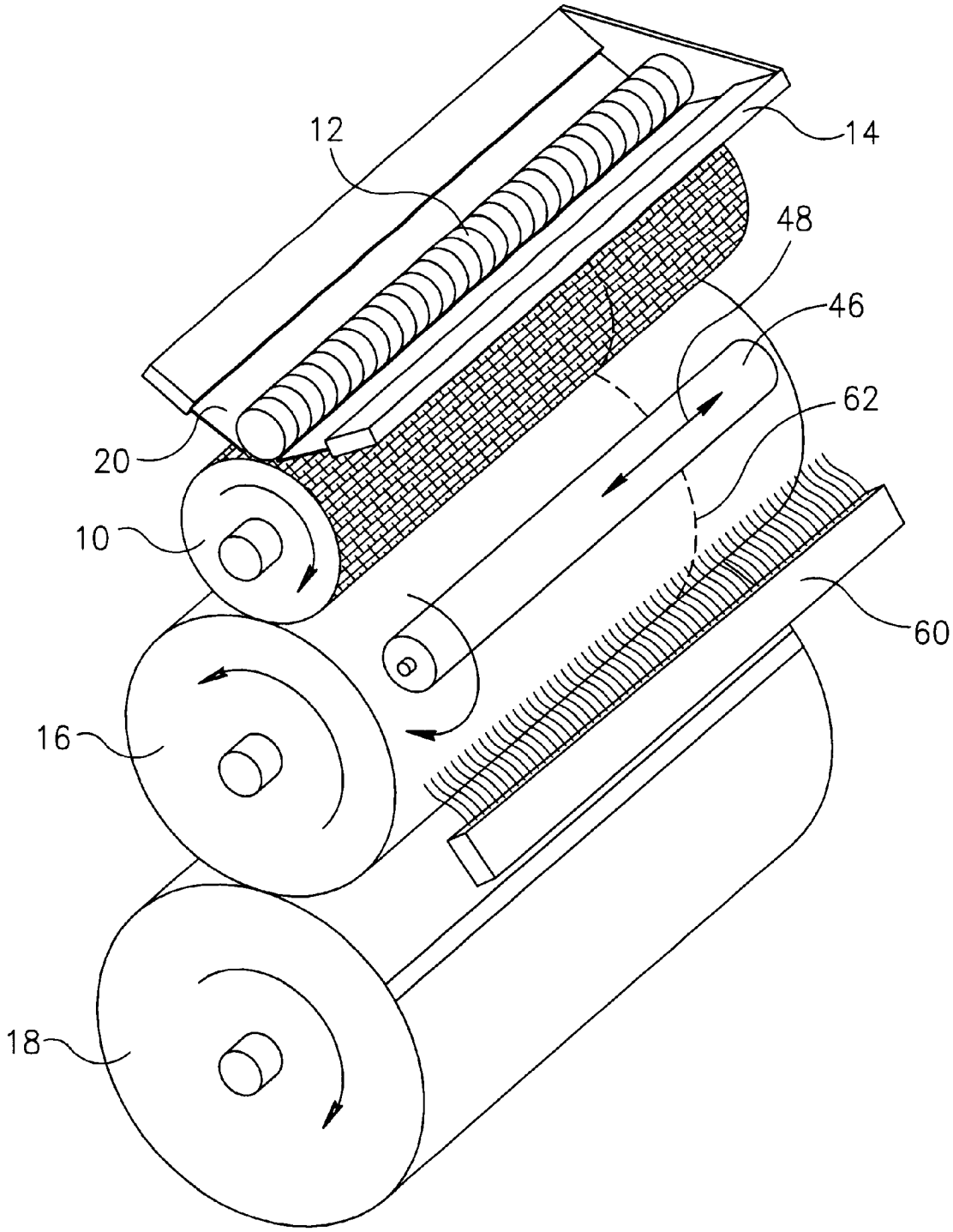
FIG. 7 shows a schematic representation of an anilox inking system having a heat-assisted mechanism for smearing of scoring marks, in accordance with an embodiments of the present invention.

FIG. 7 shows a schematic representation of heat-assisted smearing mechanism in accordance with an embodiment of the present invention. The printing press inking of FIG. 4 further comprises a heat source 60. The heat source provides a local stream of heat that raises the ink temperature of a scoring ink mark 62 by a few degrees Celsius. The heat source may direct its stream in segments of 30–35 mm (1.25 inch to 1.5 inch). It may also have the ability to vary the temperature of each of the segments independently.

In a particular test of this embodiment, the anilox score size was more than 200 microns wide and more than 15 microns deep. The ink used was Hartmann IRODRY ink, series 7074, commercially available from Hartmann, Germany. The regular roller operating temperature was 23 to 25 degrees Celsius. The score area was heated to the temperature of 30 to 32 degrees Celsius. Combined with the mechanical smearing, it substantially eliminated the scoring lines from the print.

While the above embodiment of the invention has been described with respect to the oscillating roller, it will be appreciated that any other redistribution means may be used.

Waterless offset printing inks generally have poor ink drying properties. A waterless printing press may be equipped with an infrared (IR) drying system that, when operative, creates fast ink drying conditions. According to an embodiment of the present invention, heat assisted mechanical smearing of scoring may accelerate the ink drying process and may reduce the load on a main IR ink drying system. Since the appearance of the scores is of random character, the heating system is built to cover the entire form roller surface and may be used in a similar way as a traditional ink key system. Such a system may serve as additional ink drying means and may be operative alternately as a heating system or a pre-drying system.

Image Data Modification Methods

The anilox roller scoring protection methods or ink redistribution techniques described hereinabove may require an addition of hardware to an existing anilox system. It should be noted that the scoring might appear after many working hours and installation of hardware may not be convenient. In another embodiment of the present invention, a method based on image content corrections, which may not require addition of hardware to the anilox inking system itself, is disclosed. Furthermore, the method for scoring compensation described hereinbelow may not require a lot of time and expertise from an operator, as shown in more detail in FIG. 8.

Figure 8:
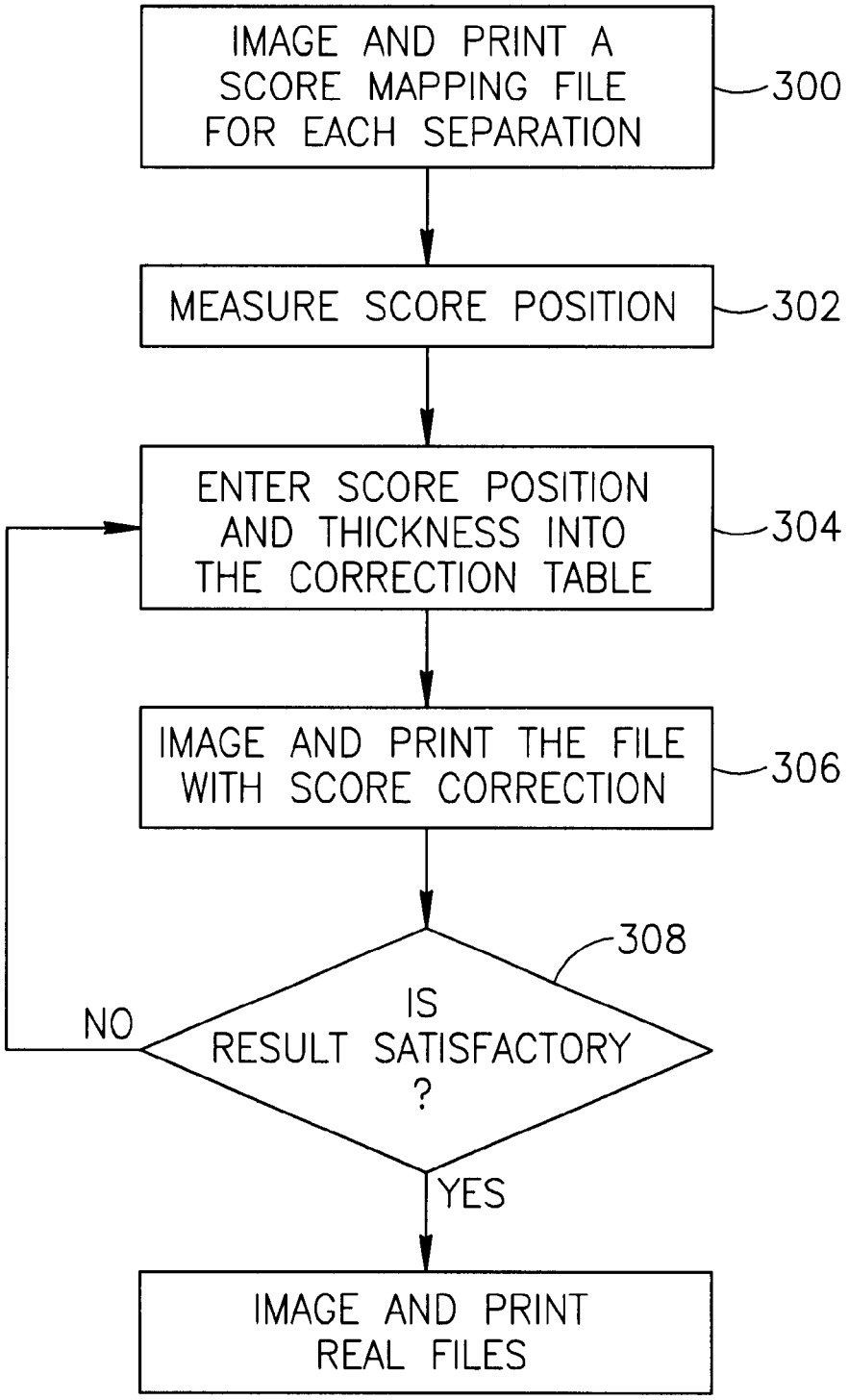
FIG. 8 is a flowchart diagram of a method for compensation of a scoring ink mark, in accordance with an embodiment of the present invention.

Reference is now made to FIG. 8 which is a flowchart illustrating the operations for correcting scoring ink marks in accordance with the present invention. Scoring effects correction is associated with the mapping of the exact position and size of the scores on the anilox roller and the corresponding area on the printed image.

Initially, a uniform screened pattern such as a 33% Dot Percent screen is printed. In a multi-color printing press system, it may be desirable to print each color separations individually, although it may be sufficient to use only the separation that contains the scored roller (step 300).

Next, the exact score position on the printed image is measured visually with a specially designed measurement pattern (shown in detail in FIG. 10). The score position on the anilox roller is also measured with appropriate measurent equipment (step 302). The measured score position and width coordinates are entered into a data file containing a score mapping and correction table (step 304). This procedure may be performed together for more than one score on the same anilox roller.

Based on the mapped score coordinates (size and position), the press and imaging control computer generates modified plate exposure data for imaging a printing plate. The plate exposure data may contain modified pixel values or instructions for subtracting segments of scanning lines and/or whole scanning lines from the image data overlapping or coinciding with the corresponding score area. The electronic device performing the method of scoring compensation is described in detail in FIG. 11. This modified image data is used in imaging the offset printing plate to be used in the subsequent printing process.

Using the modified data, the uniform screened pattern is imaged and printed (step 306). The result is then inspected for the presence of scoring marks (step 308). If the correction is satisfactory the process is terminated. If an additional measurement and correction cycle is required, the process is repeated once again. The described procedure may be equally applicable to single-beam imaging devices, multiple-beam array-type imaging devices and two dimensional matrix-type imaging devices.

Figure 9A:
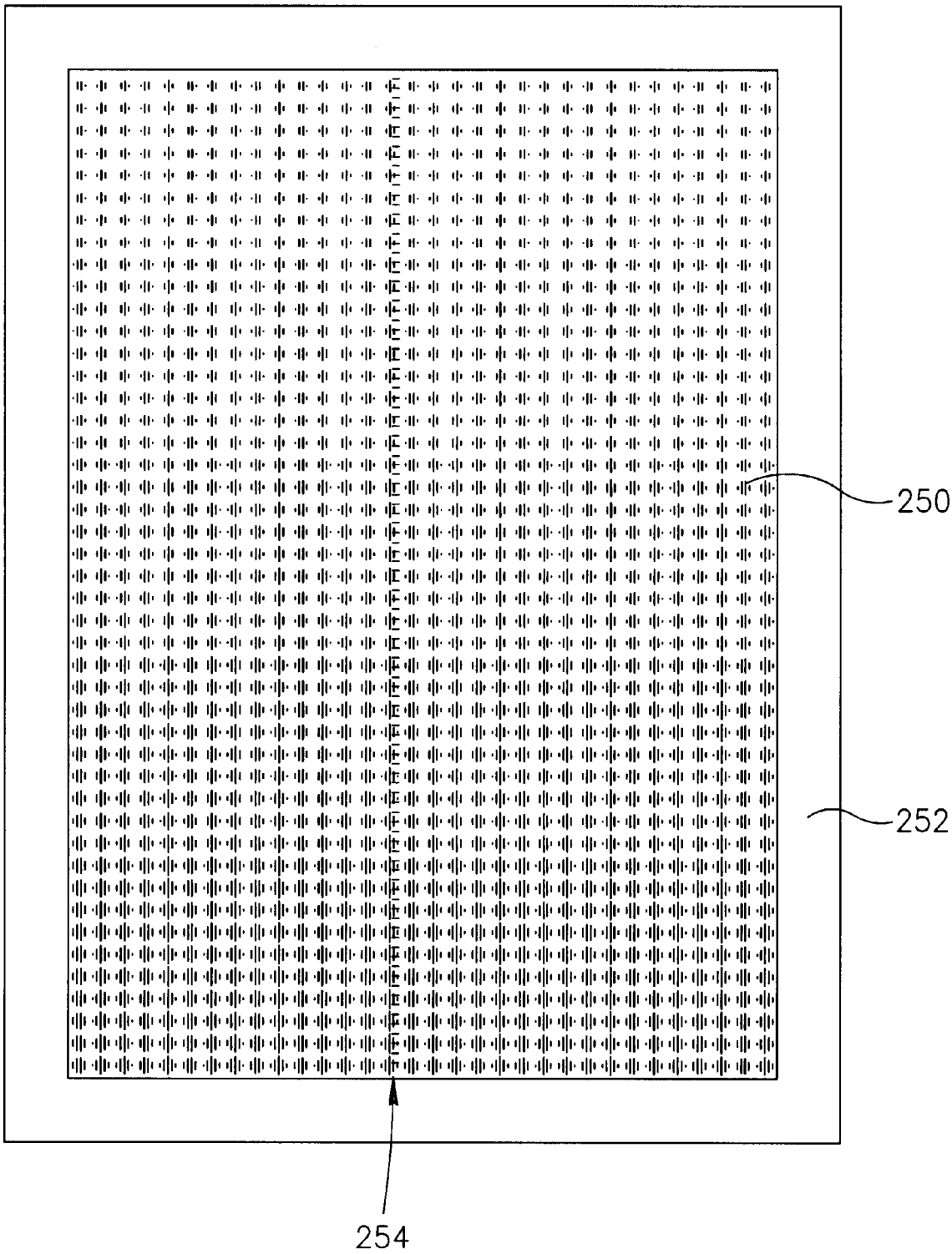
FIG. 9A is an illustration of a dégradé pattern printed on a paper sheet from a press with an anilox inking system having a score.

Once the score position and width is stored in the correction table, the modified image data is used for correcting the scoring effects. FIG. 9A is an example of a dégradé (graded) pattern 250 printed on a sheet of paper 252 using a printing press with an anilox roller with a score. The score is printed on the paper as a strip 254 having excessive ink density.

Figure 9B:
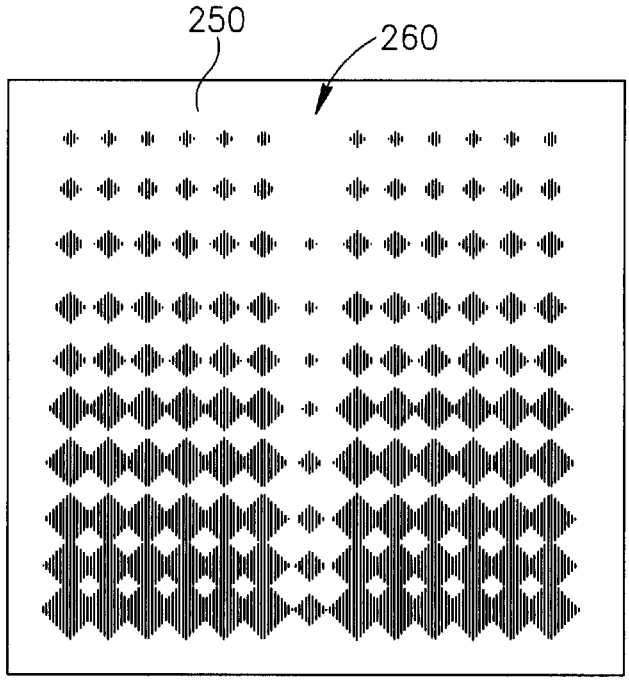
FIGS. 9B and 9C are illustrations of an image of dégradé-pattern with a soft compensation imaged on a plate cylinder of the press of FIG. 9A, according to an embodiment of the present invention.

FIG. 9B is an image on a printing plate of the same printing press of FIG. 9A. The original file data has been modified by using lower values of dot density in the score area. The score artifacts may be corrected by introducing a screen pattern of lower value than the original one.

The original dégradé pattern 250 ranges from 100% to 0%. It is replaced, at an area corresponding to the coordinates of a score with a second dégradé screen pattern 260 of 70% to 0%. This correction operation significantly reduces the plate ink pick-up and accordingly the ink density of strip 254 (FIG. 9A) and makes the strip less discernable on the printed paper. The scoring masking effect introduced by this method may work better on shadows, leaving some minor artifacts in flesh tones.

Figure 9C:
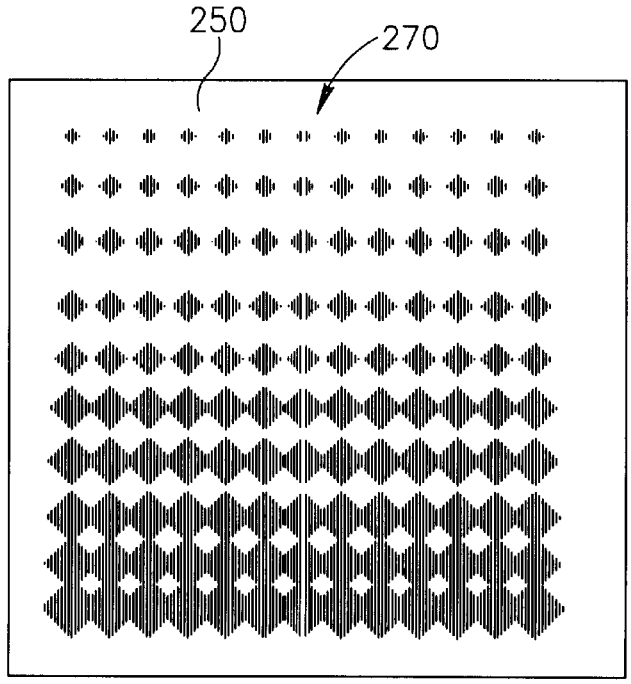

FIG. 9C is an image on a printing plate of the same printing press of FIG. 9A after subtracting scanning lines. In an embodiment of the present invention, artifacts of a score may be corrected by subtracting at least one scanning line from the image data corresponding to the score area.

In area 270, a number of scanning lines has been modified from the original image information related to dégradé pattern 250. The number and sequence of the modified lines varies and depends on the particular image content. For example, by removing data pixels, consecutive lines up to 25 lines may be modified. Typically, best results are achieved when every second or third data pixel of a line in the range covering the width of the score is removed.

The embodiments of the present invention illustrated in FIGS. 9B and 9C may be implemented in either software or hardware means or any combination therein.

The imaging on "computer-to-plate" devices and on presses with "on-press plate imaging" may be performed in a "helical imaging" mode. The helical mode may improve the imaging device throughput but may result in a slightly slanted picture on the plate image. The slant is increased as the number of energy sources participating in the imaging process is increased.

Score compensation in this case is performed in a segmented manner where the scanning line to be modified is approximated by a series of segments. Better compensation of score lines may be implemented if the resulting image has a rectangular form with its scanning lines perpendicular to the plate cylinder axis. Such a method is disclosed in a pending patent application entitled "Digital skew correction method and apparatus for multi color printing machine", filed concurrently herewith and assigned to the common assignee of the present application and hereby incorporated by reference.

For appropriate compensation the score position on the image has to be measured with reasonable accuracy. A measurement accuracy of ten microns has been found to be sufficient for proper score effect compensation. Such measurement accuracy usually requires special measuring devices not readily available at conventional printing sites.

Figure 10A:
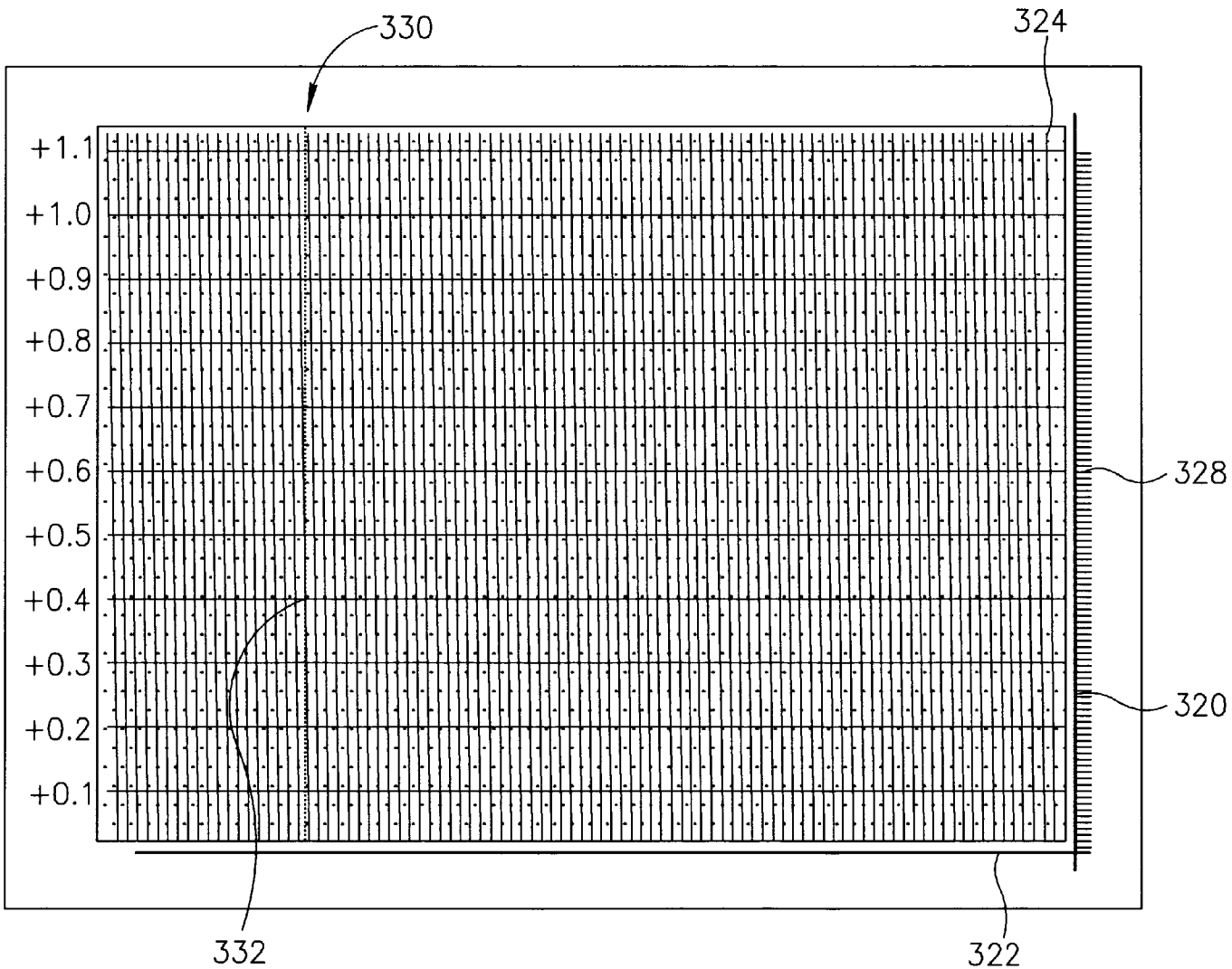
FIG. 10A is an illustration of a measurement pattern, in accordance with the present invention.
Figure 10B:
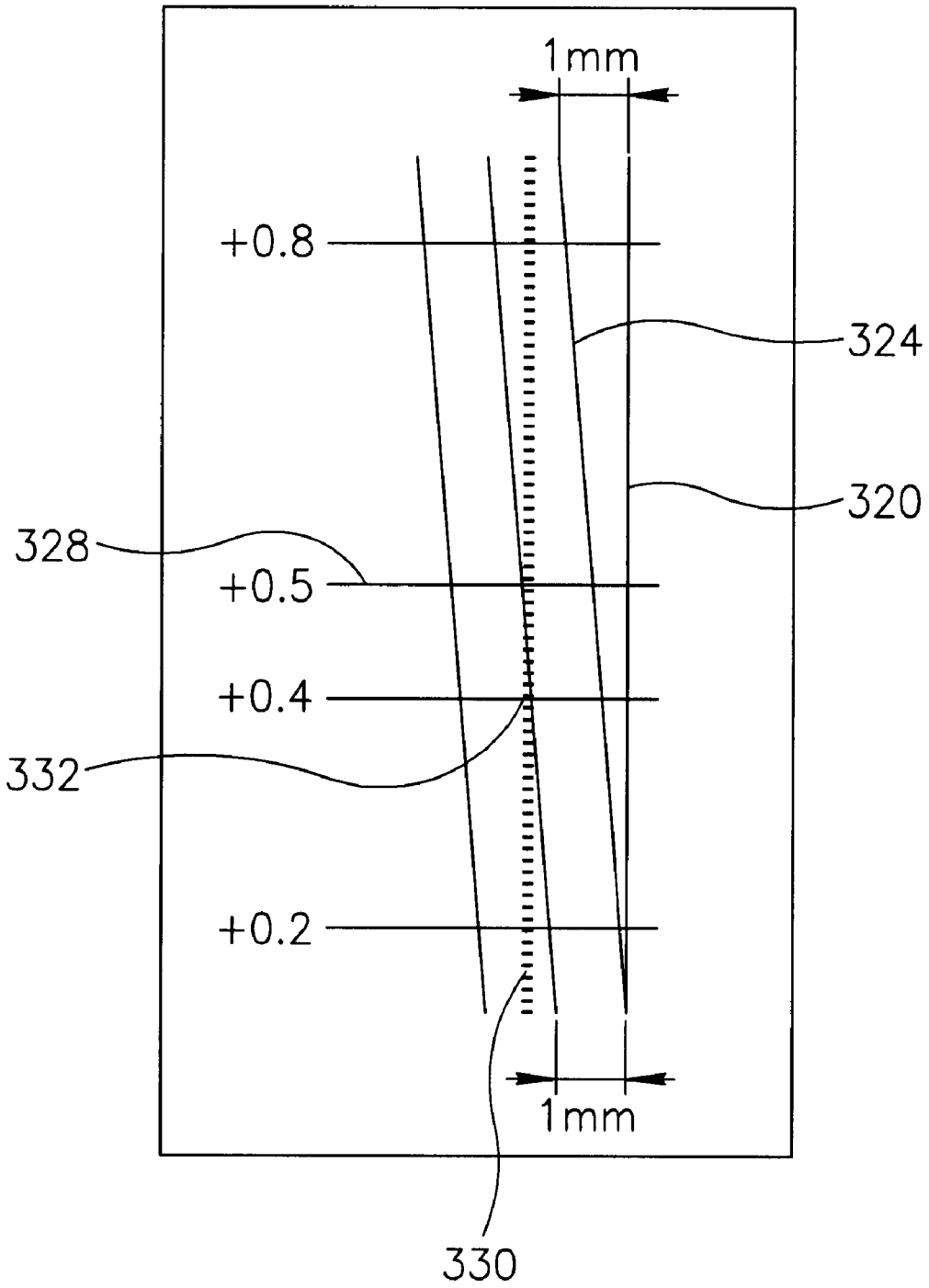
FIG. 10B is an enlarged view of a portion of the measurement pattern of FIG. 10A.

FIGS. 10A and 10B illustrate a measurement pattern in accordance with an embodiment of the present invention, which allows measurements of the score position with an accuracy of ten microns.

FIGS. 10A and 10B show a printed image of a digital file, which comprises of two combined files: a special measurement pattern and a digital file of a uniform screened pattern, such as, a 33% Dot Percent screened pattern. The measurement pattern comprises a horizontal ruler 322 for measuring positions at accuracy of millimeters. The measurement pattern further comprises a vertical ruler 320 perpendicular to the horizontal ruler 322, a plurality of slanted lines 324 which are tilted at a small angle of approximately 0.001–0.005 radians from the top of vertical ruler 320 and a plurality of equally spaced horizontal lines 328.

In this particular embodiment, the spacing between slanted lines 324 is one millimeter, and the spacing between horizontal lines 328 represent one tenth of a millimeter on the horizontal ruler, although a different spacing is possible. A scoring mark 330 intersects both a particular slanted line and a particular horizontal line at an intersection point 332. The horizontal coordinate of scoring mark 330 is determined by combining a vertical coordinate corresponding to the particular horizontal line as measured on vertical ruler 320 to the measurement of the position of the particular slanted line on horizontal ruler 322.

Vertical ruler 320 improves the horizontal measurement and increases the accuracy of the score position measurement. Each notch of vertical ruler 320 indicates a movement of 10 micrometers on the horizontal ruler, meaning a movement of 10 micrometers (microns) of the score will change the reading on the ruler in one notch.

Figure 11:
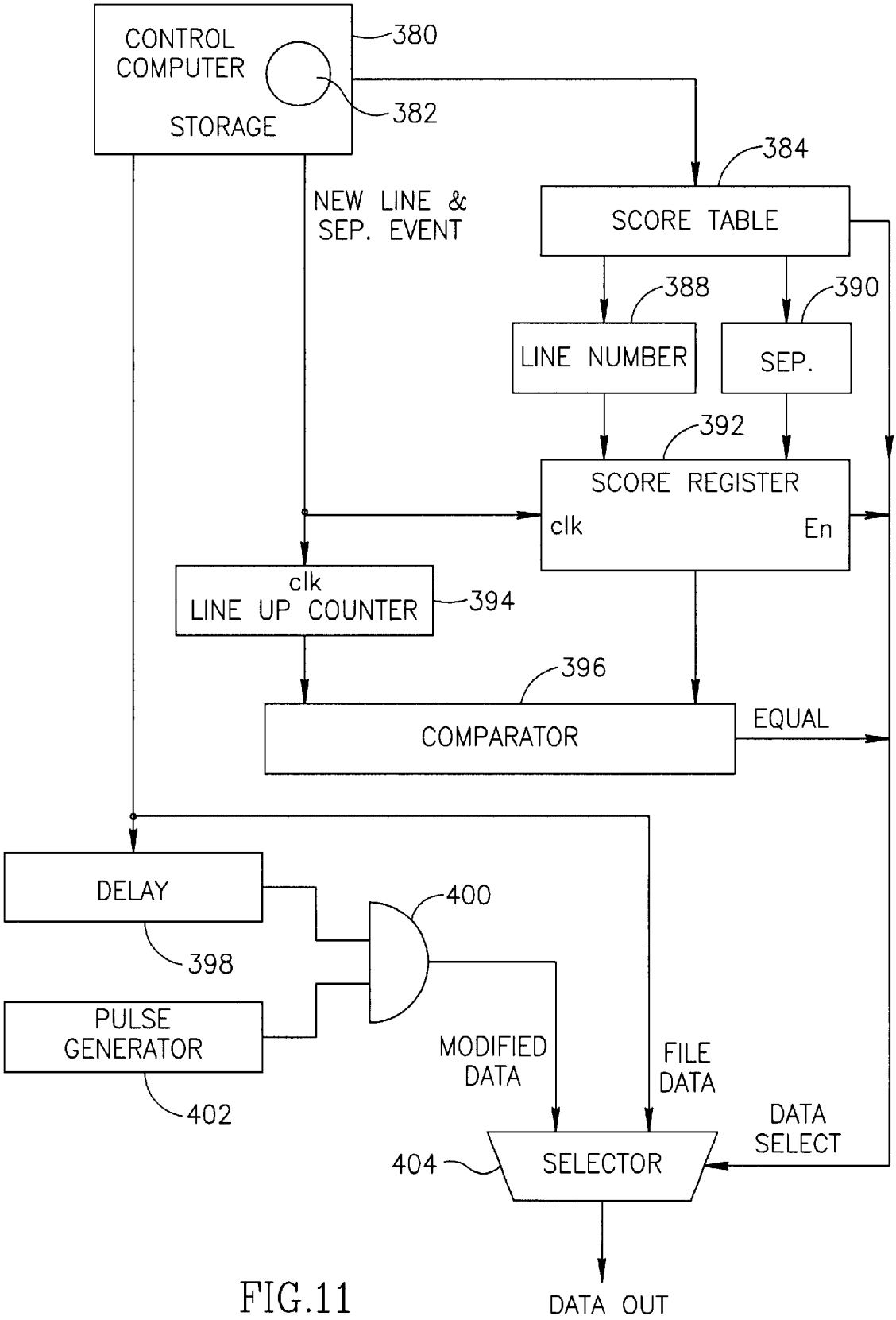
FIG. 11 is a block diagram of an electronic device adapted to compensate for scoring marks, in accordance with an embodiment of the present invention.

Reference is now made to FIG. 11, which is a block diagram of an electronic device performing the methods described hereinabove. A control computer 380 extracts original image data, stored in a storage device 382, such as a hard disk. A score position table 384, prepared ahead of time according to the method described in FIG. 8, is loaded into a memory governing the exposure process.

The score data loaded into the memory contains information on the score position with respect to the origin of an anilox roller, separation name, for example, Cyan or Magenta, score width and image offset. Image offset, defines the position of the score on the image itself. This score information is processed and converted into a scanning line number 388 and an associated separation 390. Both parameters are loaded, into a score register 392 which counts the scores.

Substantially concurrent to this procedure, an image line counter 394 counts the original image lines. Both numbers are loaded into a comparator 396 and compared. Equal line numbers mean that the original image lines fall into the score positions and should be modified.

The original image data may be delayed by a delay 398 and combined in an AND gate 400 with appropriate pulses generated by a pulse generator 402. When the lines are equal, a selector 404 selects the modified data from the outputs of AND gate 400 instead of the original file data. The modified data govern the on-and-off exposure cycle of the laser beam (not shown).

Figure 12:
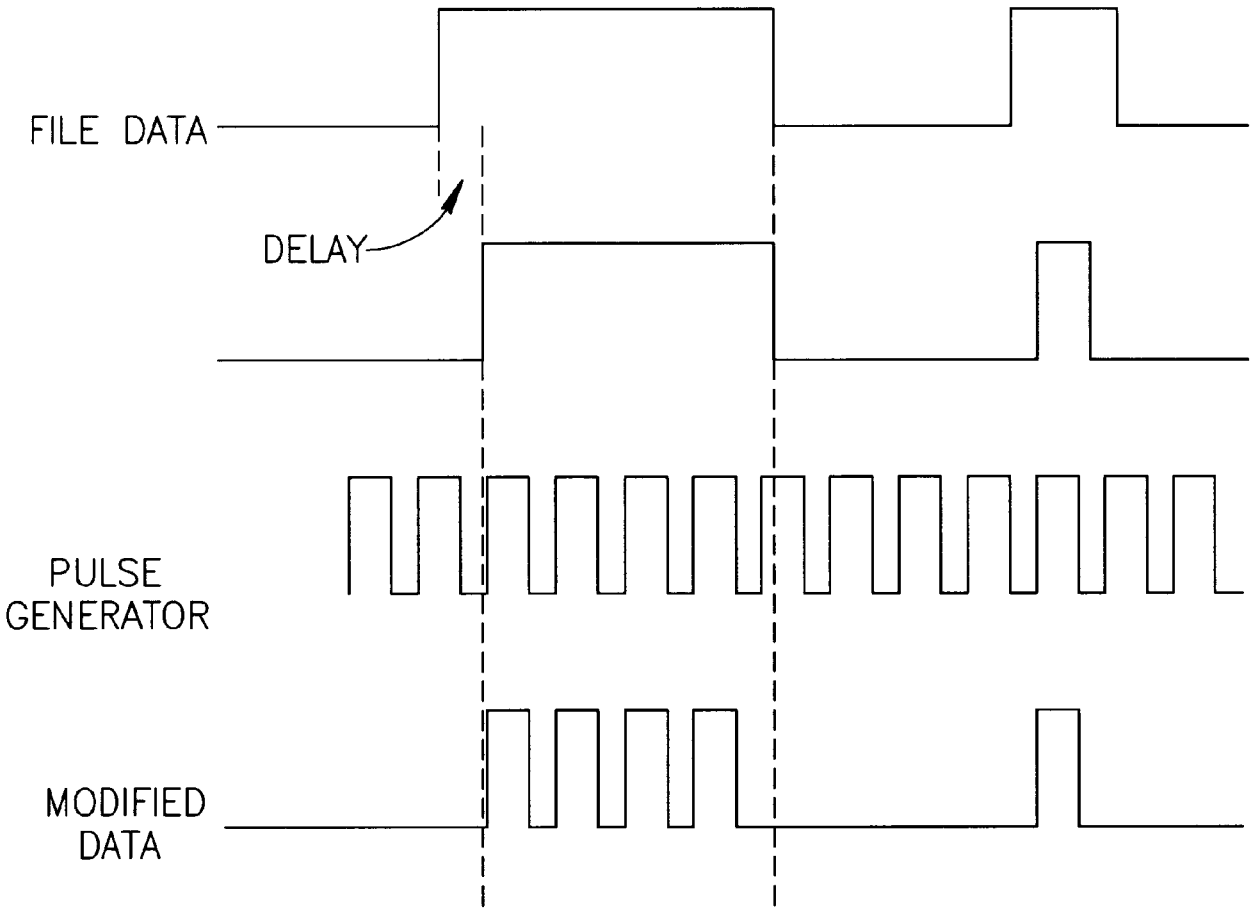
FIG. 12 is a timing diagram for the device of FIG. 11.

The timing diagram of the process is shown on FIG. 12. The number of lines to be modified is a function of the ink density which is dependent upon the score width and the gray level of the original image. Pulse generator 402 generates pulses with a duty cycle according to the score ink-density. Higher score density requires lower duty cycle of the pulse. The original data on the score position is chopped according to the pulse generated by pulse generator 402. The overall density of the score will be lower on the print.

When there is more than one score on a particular anilox cylinder, the mapping process is repeated for each score and their data is loaded into the score table. At each of the successive score position the original image data is processed according to the algorithm described above.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. In a printing press having an anilox roller, a method comprising:

printing an image from original plate exposure data;

measuring geometrical properties of a scoring mark in said image;

modifying said original plate exposure data from a correction table including said measured geometrical properties of said scoring mark; and imaging a printing plate of said printing press using said modified plate exposure data.

2. The method of claim 1 wherein said modifying comprises:

altering pixel values in said original plate exposure data that correspond to said geometrical properties of said scoring marks.

3. The method of claim 1, wherein said modifying comprises:

altering scanning line values in said original plate exposure data that correspond to said geometrical properties of said scoring marks.

4. The method of claim 1, wherein said modifying comprises:

skipping at least portions of scanning lines in said original plate exposure data that correspond to said geometrical properties of said scoring marks.

* * * * *